US008561973B2

(12) United States Patent
Martin

(10) Patent No.: US 8,561,973 B2
(45) Date of Patent: Oct. 22, 2013

(54) PULL ACTION CLAMP WITH TOGGLE LOCK

(75) Inventor: David Martin, Dearborn, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 590 days.

(21) Appl. No.: 12/356,222

(22) Filed: Jan. 20, 2009

(65) Prior Publication Data

US 2010/0181710 A1 Jul. 22, 2010

(51) Int. Cl.

| | |
|---|---|
| ***B25B 1/00*** | (2006.01) |
| ***B25B 1/02*** | (2006.01) |
| ***B25B 5/02*** | (2006.01) |
| ***B25B 1/14*** | (2006.01) |
| ***B25B 5/12*** | (2006.01) |

(52) U.S. Cl.
USPC ..... 269/6; 269/3; 269/228; 269/201

(58) Field of Classification Search
USPC ..... 269/3, 6, 228, 201
See application file for complete search history.

(56) References Cited

U.S. PATENT DOCUMENTS

| | | | | |
|---|---|---|---|---|
| 1,503,237 | A | 7/1924 | Guenther | |
| 2,443,153 | A | 6/1948 | Wells | |
| 2,800,823 | A | 7/1957 | Tugend | |
| 3,118,331 | A | 1/1964 | Kreger | |
| 4,141,543 | A | 2/1979 | Kato | |
| 4,720,282 | A | 1/1988 | Chase et al. | |
| 5,165,148 | A * | 11/1992 | Fleischer et al. | 24/494 |
| 5,517,164 | A * | 5/1996 | Zoller et al. | 335/16 |
| 5,527,024 | A | 6/1996 | Dysktra | |
| 5,772,193 | A | 6/1998 | Dykstra | |
| 6,240,815 | B1 | 6/2001 | Huang | |
| 6,684,465 | B1 | 2/2004 | Jo | |
| 6,745,441 | B1 | 6/2004 | Lin | |
| 6,932,335 | B1 * | 8/2005 | Dykstra | 269/228 |
| 7,213,848 | B2 * | 5/2007 | Hagan | 292/247 |
| 2007/0018372 | A1 | 1/2007 | Sun | |
| 2007/0102859 | A1 * | 5/2007 | Hagan et al. | 269/228 |

FOREIGN PATENT DOCUMENTS

| | | |
|---|---|---|
| DE | 90 16 964 | 4/1992 |
| DE | 44 36 044 | 4/1995 |
| DE | 297 08 566 | 7/1997 |

(Continued)

OTHER PUBLICATIONS

"distinct". MacMillan Dictionary. 2009-2012. <http://www.macmillandictionary.com/dictionary/american/distinct#distinct_3>.*

*Primary Examiner* — Monica Carter
*Assistant Examiner* — Seahee Yoon
(74) *Attorney, Agent, or Firm* — Harness, Dickey & Pierce, P.L.C.

(57) ABSTRACT

A clamp for clamping a work piece to a fixture includes a base for mounting to the fixture and a handle having a body portion and an arm portion. The handle includes a pivotal connection to the base. The clamp further includes a holding member and a latch. The holding member has a holding position for clamping the work piece to the fixture and a pivotal connection to the handle. The latch includes a first end portion and a second end portion. The first end portion is engaged with the base for locking the holding member in the holding position and becomes disengaged from the base by moving the second end portion in a direction generally away from the arm portion of the handle. The latch has a pivotal connection to the handle.

20 Claims, 4 Drawing Sheets

(56) References Cited

FOREIGN PATENT DOCUMENTS

| | | |
|---|---|---|
| DE | 10 2004 033 140 | 1/2006 |
| DE | 10 2006 043 583 | 3/2008 |
| EP | 1 967 324 | 5/2011 |
| GB | 2 155 537 | 9/1985 |

* cited by examiner

PULL ACTION CLAMP WITH TOGGLE LOCK

FIELD

The present disclosure relates to clamps generally and, more particularly, to a hold down clamp with a latch that locks the hold down clamp in an open or a closed position.

BACKGROUND

Hold down clamps typically include a clamping arm that can pivot between an open or disengaged position and a closed or engaged position. Hold down clamps can be used to hold work pieces in place during processing and for clamping multiple objects together. Hold down clamps are designed to quickly engage and disengage from the work piece or objects being held. Many of the hold down clamps include a toggle or latch in order to lock the hold down clamp in an engaged position. The latch can be unlocked when an operator desires to move the clamping arm to the disengaged position.

The latch prevents the clamping arm from being unintentionally released. The latch typically includes a lever portion that an operator must compress against a top surface of the hold down clamp handle or a bottom surface of the hold down clamp handle in order to unlock the latch. When the lever is repetitively compressed, such as in a production environment where the work pieces are frequently changed, the operator may develop a discomfort in their hand. The lever requires a handle portion to allow the operator to firmly grasp the lever in order to compress it against the hold down clamp handle. It is desirable to have a robust hold down clamp that can be released from the engaged position without compressing the handle portion of the lever toward the hold down clamp handle. This may also enable a smaller and lower cost lever to be implemented.

SUMMARY

The present teachings provide a hold down clamp having a latch that can be unlocked by an operator using their thumb. The latch enables the operator to keep their hand on a handle of the hold down clamp while simultaneously releasing the latch. A spring is used to lock the latch to a base of the clamp when the operator removes their thumb from the latch and the hold down clamp is in a holding position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
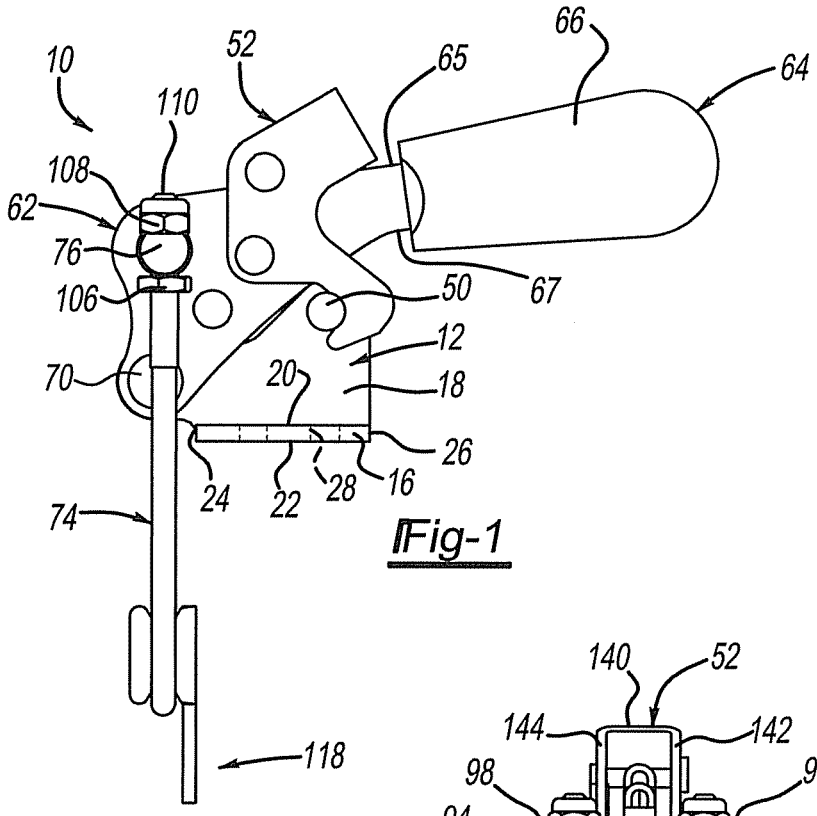
FIG. 1 is a side view of a holding clamp in an engaged position including a latch that is in a locked position in accordance with the present teachings.
Figure 2:
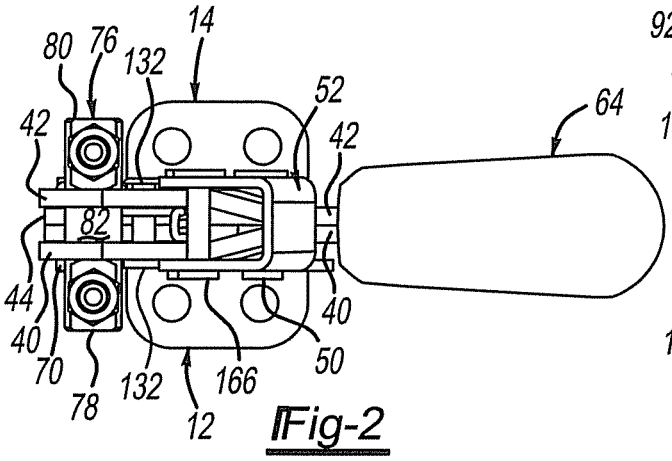
FIG. 2 is a plan view of the holding clamp of FIG. 1 in accordance with the present teachings.
Figure 3:
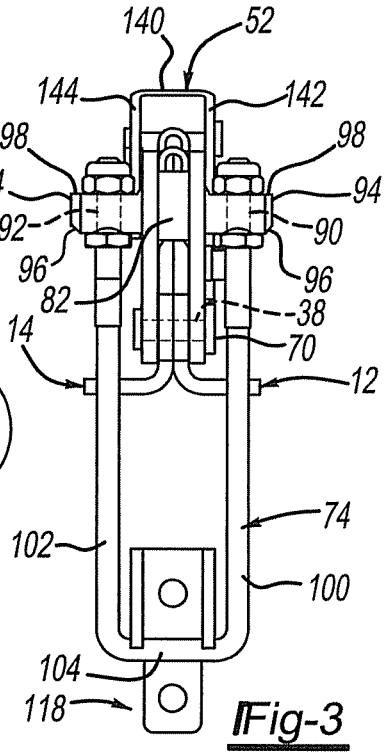
FIG. 3 is a front view of the holding clamp of FIG. 1 in accordance with the present teachings.
Figure 4:
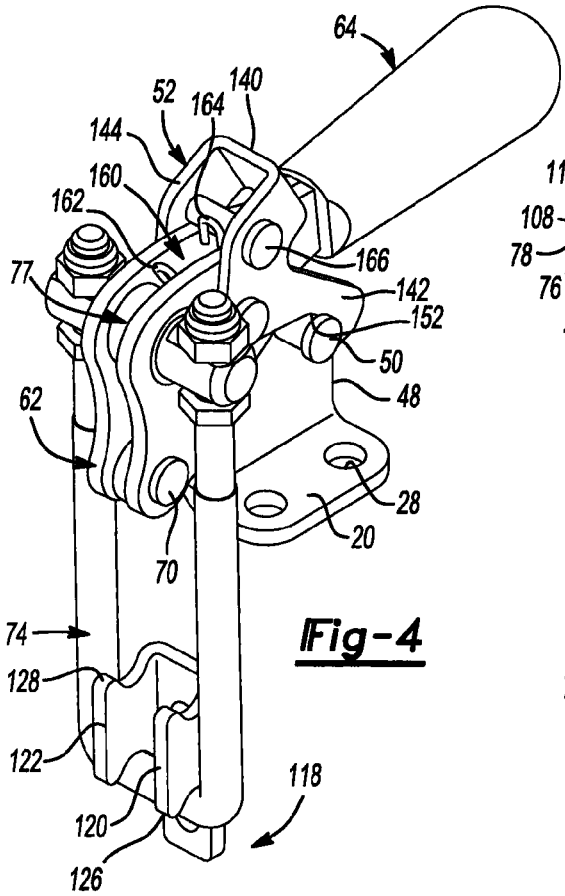
FIG. 4 is a forward partial perspective view of the holding clamp of FIG. 1 in accordance with the present teachings.
Figure 5:
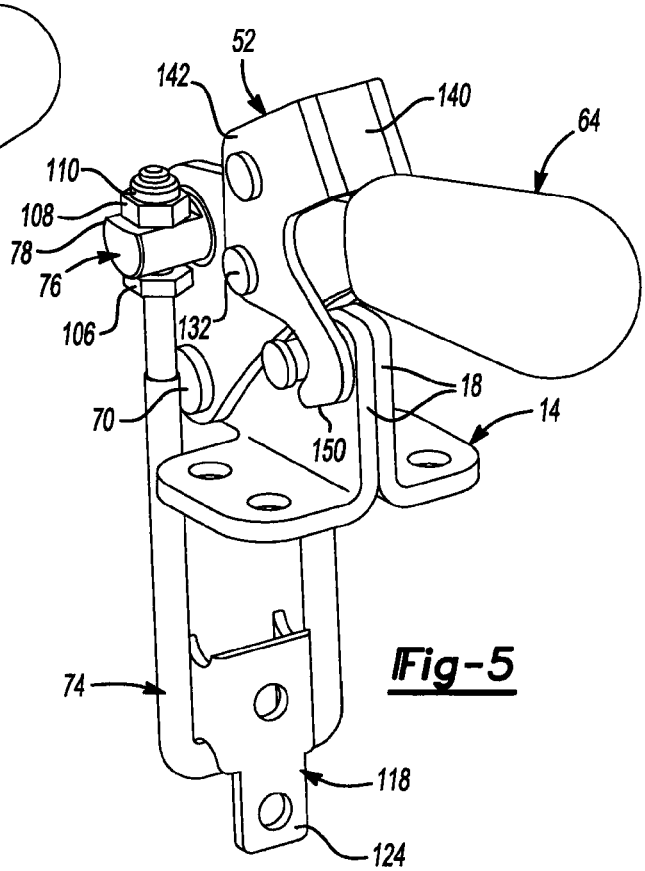
FIG. 5 is a rearward partial perspective view of the holding clamp of FIG. 1 in accordance with the present teachings.
Figure 6:
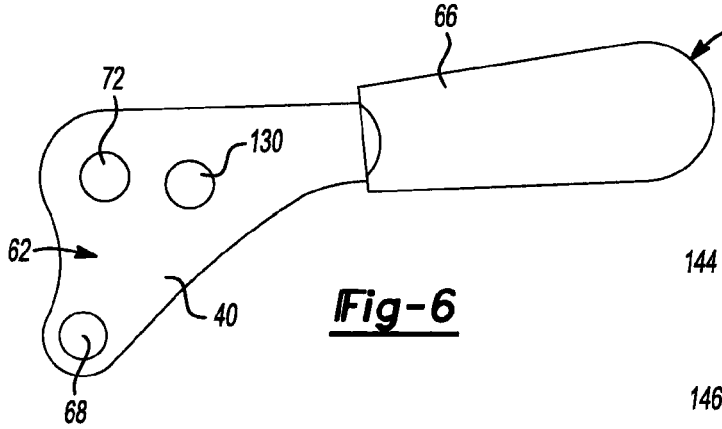
FIG. 6 is a side view of a handle member of the holding clamp of FIG. 1 in accordance with the present teachings.
Figure 7:
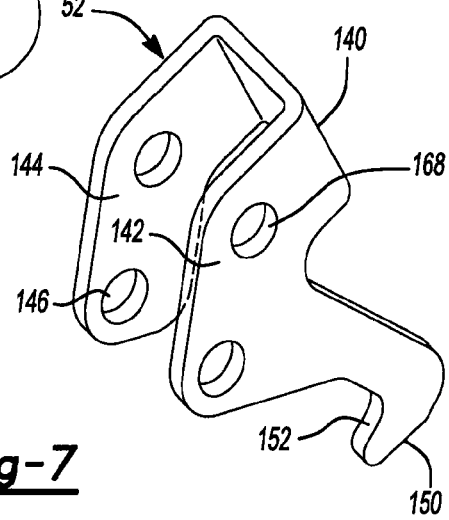
FIG. 7 is a perspective view of the latch of FIG. 1 in accordance with the present teachings.

Referring now to FIGS. 1-9, a holding clamp 10 is shown in accordance with the present teachings. The holding clamp 10 is shown oriented along a horizontal axis and engaging a work piece along a vertical axis. This orientation is for exemplary purposes and it is appreciated that the holding clamp 10 can be oriented to mount in any position suitable to one skilled in the art. The holding clamp 10 includes a first base member 12 and a second base member 14, each generally having an L-shaped cross-section.

The first and second base members 12, 14 include a horizontal flange 16 and a vertical flange 18. The horizontal flange 16 includes a first surface 20 and second surface 22. The horizontal flange 16 also includes a first end 24 and a second end 26. The horizontal flange 16 can include a pair of apertures 28 formed between the first and second surface 20, 22. The first end 24 of the first and second base members 12, 14 can be aligned with an edge of a fixture and secured via fasteners. Alternatively the first and second base members 12, 14 may be riveted, bonded, or welded to the fixture.

The vertical portion 18 of the first and second base members 12, 14 includes a first aperture 36 that can connect the first and second base members 12, 14 to a first handle member 40 and a second handle member 42. The first aperture 36 is formed near a first end 44 of the vertical portion 18 of the first and second base members 12, 14. The first end 44 of the vertical portion 18 is perpendicular to the first end 24 of the first and second base members 12, 14 such that the first end 44 projects away from the first end 24. A second aperture 38 is formed near a second end 48 of the vertical portion 18. The second aperture 38 receives a latch pin 50. The latch pin 50 secures a latch 52 when the holding clamp 10 is engaged with a work piece. The vertical portion 18 of the first and second base members 12, 14 are mechanically or chemically bonded to one another to form a single unit.

The first and second handle members 40, 42 include a body portion 62 and an arm portion 64 that extends from the body portion 62. The body portion 62 and the arm portion 64 intersect near an offset or bend in the first and second handle members 40, 42. The arm portion 64 of the first and second handle members 40, 42 are in contact with each other. The body portion 62 of the first and second handle members 40, 42 are offset from each other. The arm portion 64 includes a top surface 65 and a bottom surface 67. The bottom surface 67 is nearer to the base than the top surface in a clamped position (see FIG. 1). They enable the vertical portion 18 to be positioned between the first and second base members 12, 14. The first and second handle members 40, 42 are mechanically or chemically bonded to one another to form a single unit. The first and second handle members 40, 42 include a grip 66 that can be fixed on the arm portion 64 of the first and second handle members 40, 42. The body portion 62 of the first and second handle members 40, 42 includes a first aperture 68 that pivotally connects the first and second handle members 40, 42 to the vertical portion 18 of the first and second base members 12, 14. The connection can be made using a first pivot pin 70 passing through apertures 68 and 36. The first and second handle members 40, 42 can pivot about the first pivot pin 70 between a first position and a second position.

The body portion 62 of the first and second handle members 40, 42 includes a second aperture 72 that pivotally connects the first and second handle members 40, 42 to a holding member 74. The pivotal connection between the first and second handle members 40, 42 and the holding member 74 is made using a holding member pin 76. The holding member pin 76 includes a first end 78, a second end 80, and a middle portion 82. The middle portion 82 of the holding member pin 76 has a circular cross-section that corresponds to a circular cross-section of the second aperture 72. A first aperture 90 is formed near the first end 78 of the holding member pin 76. Similarly, a second aperture 92 is formed near the second end 80 of the holding member pin 76. The holding member pin 76 is arranged such that a first end 94 of each of the first and second apertures 90, 92 face in a generally upward direction. A second end 96 of each of the first and second apertures 90, 92 faces in a generally downward direction. The holding member pin 76 includes a flat portion 98 formed adjacent the first end 94 of each of the first and second apertures 90, 92. The flat portion 98 enables a fastener, such as a nut to fully seat against the holding member pin 76 when connected to the holding member 74.

The holding member 74 includes a first leg 100 and a second leg 102 that each extend perpendicularly from a middle portion 104. The middle portion 104 and the first and second legs 100, 102 have a circular cross-section or any other shape suitable to one skilled in the art. A male thread is formed on a portion of each of the first and second legs 100, 102 near an end that is opposite the middle portion 104. A first fastener 106 is threaded onto the first and second legs 100, 102 of the holding member 74. The first fastener 106 prevents the holding member 74 from moving in a first direction when the holding member 74 is connected to the holding member pin 76.

The holding member 74 is connected to the holding member pin 76 by inserting the first and second legs 100, 102 of the holding member 74 into the second end 96 of the first and second apertures 90, 92 formed in the holding member pin 76. A portion of the first and second legs 100, 102 extends through the first end 94 of the first and second apertures 90, 92. This enables a second fastener 108 to be threaded onto each of the first and second legs 100, 102 of the holding member 74. The second fastener 108 is tightened to secure the holding member 74 to the holding member pin 76.

The middle portion 104 of the holding member 74 is attached to a work piece using a bracket 118 when the first and second handle members 40, 42 are in the second (engaged) position. The first and second handle members 40, 42 are rotated toward the first (disengaged) position to enable the holding member 74 to be removed from the bracket 118. The bracket 118 has a first flange 120 and a second flange 122 that extend perpendicularly from a middle portion 124 of the bracket 118. Each of the first and second flanges 120, 122 have a first end 126 that receives the middle portion 104 of the holding member 74. A second end 128 is formed opposite the first end 126. The bracket 118 is mechanically attached to the work piece using fasteners such as a screws, bolts, or rivets.

The body portion 62 of the first and second handle members 40, 42 includes a third aperture 130 that pivotally connects the latch 52 to the first and second handle members 40, 42 via a second pivot pin 132. The latch 52 includes a middle portion 140, a first leg 142, and a second leg 144. Both legs 142, 144 extend perpendicularly from the middle portion 140. The middle portion 140 is formed at a predetermined angle with respect to the handle. This enables operator's thumb to force the latch 52 in a direction generally away from the arm portion 64 of the first and second handle members 40, 42, when the operator intends to unlock the latch 52. The middle portion 140 of the latch 52 has a width that is greater than the width of the body portion 62 of the first and second handle members 40, 42. This enables the first and second legs 142, 144 of the latch 52 to be positioned over (or straddle) the body portion 62 of the first and second handle members 40, 42.

The first and second legs 142, 144 of the latch 52 include a first aperture 146 that is aligned with the third aperture 130 formed in the body portion of the first and second handle members 40, 42. When the first aperture 146 of the latch 52 and the third aperture 130 of the body portion 62 are in an alignment, the body portion 62 of the first and second handle members 40, 42 is pivotally connected to the latch 52 using the second pivot pin 132. The second pivot pin 132 defines the rotational axis of the latch 52 which it is operable to rotate about in a first and a second direction.

When the operator applies a force against the middle portion 140 of the latch 52, the middle portion 140 of the latch 52 moves generally away from the arm portion 64 of the first and second handle members 40, 42 in the first direction. Moving the middle portion 140 in the first direction enables the latch 52 to become disengaged from the first and second base members 12, 14. In the second direction, the middle portion 140 of the latch 52 moves generally toward the arm portion 64 of the first and second handle members 40, 42. This engages the latch 52 with the first and second base members 12, 14.

The first leg 142 of the latch 52 includes a first end portion 150 that forms a hook 152. The hook 152 is defined by a curvilinear peripheral edge. The hook 152 engages the latch pin 50. The curvilinear peripheral edge of the hook 152 is in contact with the latch pin 50 when the first and second handle members 40, 42 of the holding clamp 10 are in the engaged position. Accordingly, the latch 52 is in a locked position. When the operator forces the latch 52 in the first direction, the latch 52 moves to its unlocked position and the hook 152 disengages the latch pin 50. The first and second handle members 40, 42 can be raised to disengage the holding clamp 10. It is understood that the second leg 144 of the latch 52 may also include the first end portion 150 that forms the hook 152 (not shown). Here, if desired, it secures the second leg 144 of the latch 52 to the first and second base members 12, 14. Additionally, the latch 52 may automatically engage the pin 50 upon closing of the handle 64. Here, the handle 64 is moved in the second direction towards the base members 12, 14. A bottom surface 153 of the hook 152 contacts the pin 50. As this occurs, the latch 52 is moved in the first direction lifting away from the handle 64. After a tip 155 of the hook 152 passes over the pin 50, a spring 160 forces the latch 52 in the second direction so that the hook 152 is captured on the pin 50. Thus, closing of the handle 64 automatically latches the latch 52 on the pin 50.

The spring 160 is arranged around the length of the second pivot pin 132. The spring 160 is shown as a torsion spring, however any other suitable spring may be used. The spring 160 includes a predetermined number of coils with a predetermined inner diameter. The inner diameter is greater than the outer diameter of the second pivot pin 132. The spring 160 is formed from a metal material, preferably steel. However, the spring 160 may be formed from any other known metal or composite material.

The spring 160 includes a first arm 162 and a second arm 164 that extend from the coils (not shown). The spring 160 is arranged between the first and second handle members 40, 42. Thus, it is prevented from contacting the operator's hand. The first and second arms 162, 164 are positioned between a third pivot pin 166 that is pivotally connected to the latch 52 and the holding member pin 76. The first arm 162 is in contact with a holding member bushing 77 through which the holding member pin 76 passes and the second arm 164 is in contact with the third pivot pin 166. In this arrangement, the second arm 164 urges the latch 52 into the locked position via the spring force. The third pivot pin 166 is connected to the latch 52 by positioning it in a second aperture 168 formed in the first and second legs 142, 144.

The spring force maintains the latch 52 in the locked position until the operator moves the latch 52 to the unlocked position. The spring force ensures that the latch 52 remains in contact with the latch pin 50 when the holding clamp 10 is in the engaged position. When an operator applies a predetermined force to overcome the spring force, the latch 52 rotates in the first direction and the hook 152 is no longer in contact with the latch pin 50. This enables the first and second handle members 40, 42 of the holding clamp 10 to move from the engaged position to the disengaged position. When the first and second handle members 40, 42 of the holding clamp 10 are in the disengaged position, the work piece being held can be removed from the holding member 74. The working parts of the holding clamp 10 are formed out of a metal material, preferably steel. However, the holding clamp 10 can be formed from any other known metal material.

Figure 9:
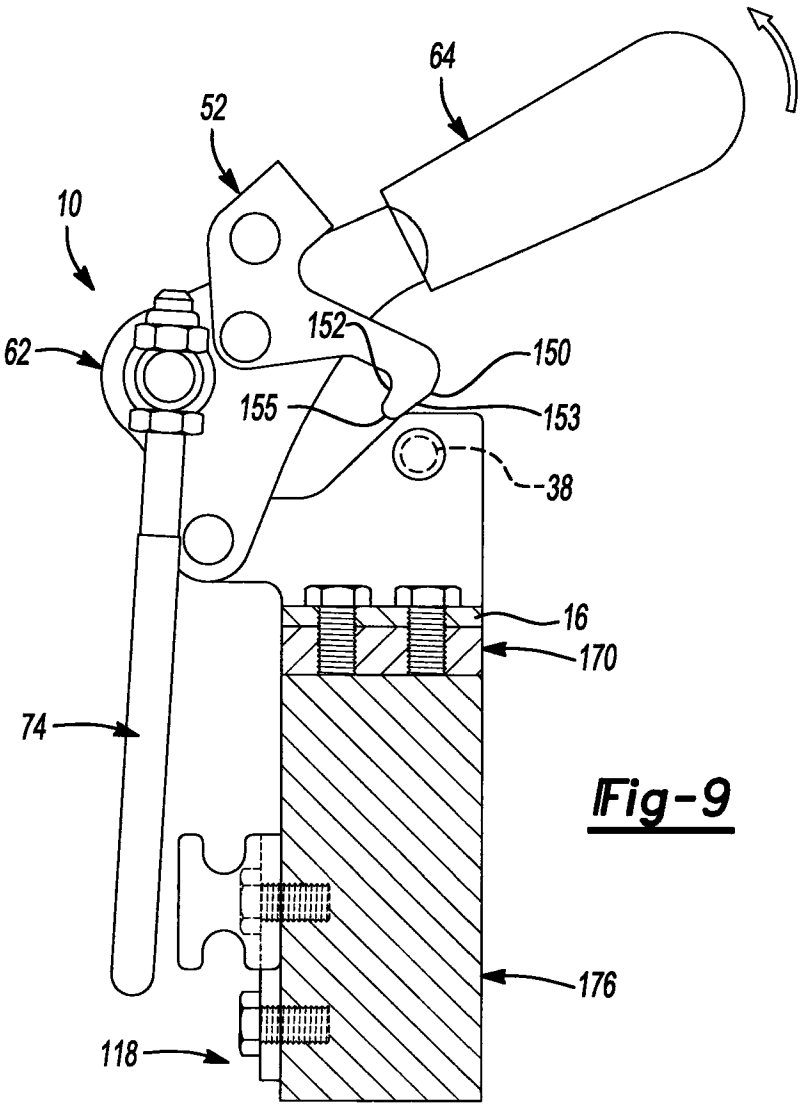
FIG. 9 is a side view of the holding clamp of FIG. 1 in a disengaged position in accordance with the present teachings.
Figure 8:
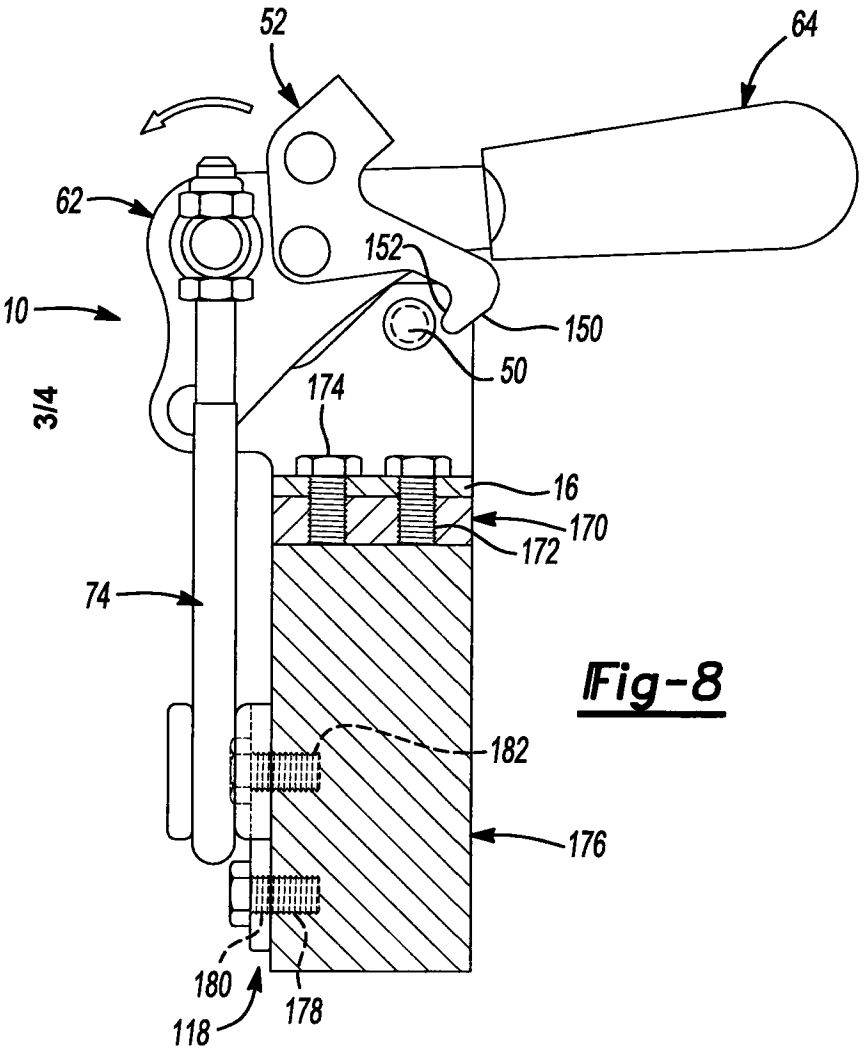
FIG. 8 is a side view of the holding clamp of FIG. 1 having a latch that is in an unlocked position in accordance with the present teachings.

With reference to FIGS. 8-9, the latch 52 is shown in an unlocked position. In the unlocked position, the latch 52 is no longer in contact with the latch pin 50. The arm portion 64 of the first and second handle members 40, 42 remains in the engaged position until the operator releases the arm portion 64 from the holding position. The horizontal flange 16 of the base members 12, 14 is shown attached to a fixture 170. The fixture 170 includes a pair of mounting holes 172. Each hole receives one of a pair of first fasteners 174. Each of the pair of first fasteners 174 can be threaded into one of the mounting holes 172 to secure the base members 12, 14 onto the fixture 170.

A bracket 118 is shown attached to a work piece 176. The work piece 176 includes a pair of threaded mounting holes 178. The bracket 118 has a pair of holes 180. Each of the pair of holes 180 is aligned with one of the threaded mounting holes 178. A pair of second fasteners 182 is used to attach the bracket 118 to the work piece 176. Each of the pair of second fasteners 182 is positioned into one of the pair of holes 180. They are threaded into one of each of the pair of mounting holes 178. In FIG. 9, the arm portion 64 of the first and second handle members 40, 42 is shown moving toward the disengaged position. This enables the holding member 74 to become disengaged from the bracket 118. Thereafter, the work piece 176 can be removed from the holding member 74.

Figure 10:
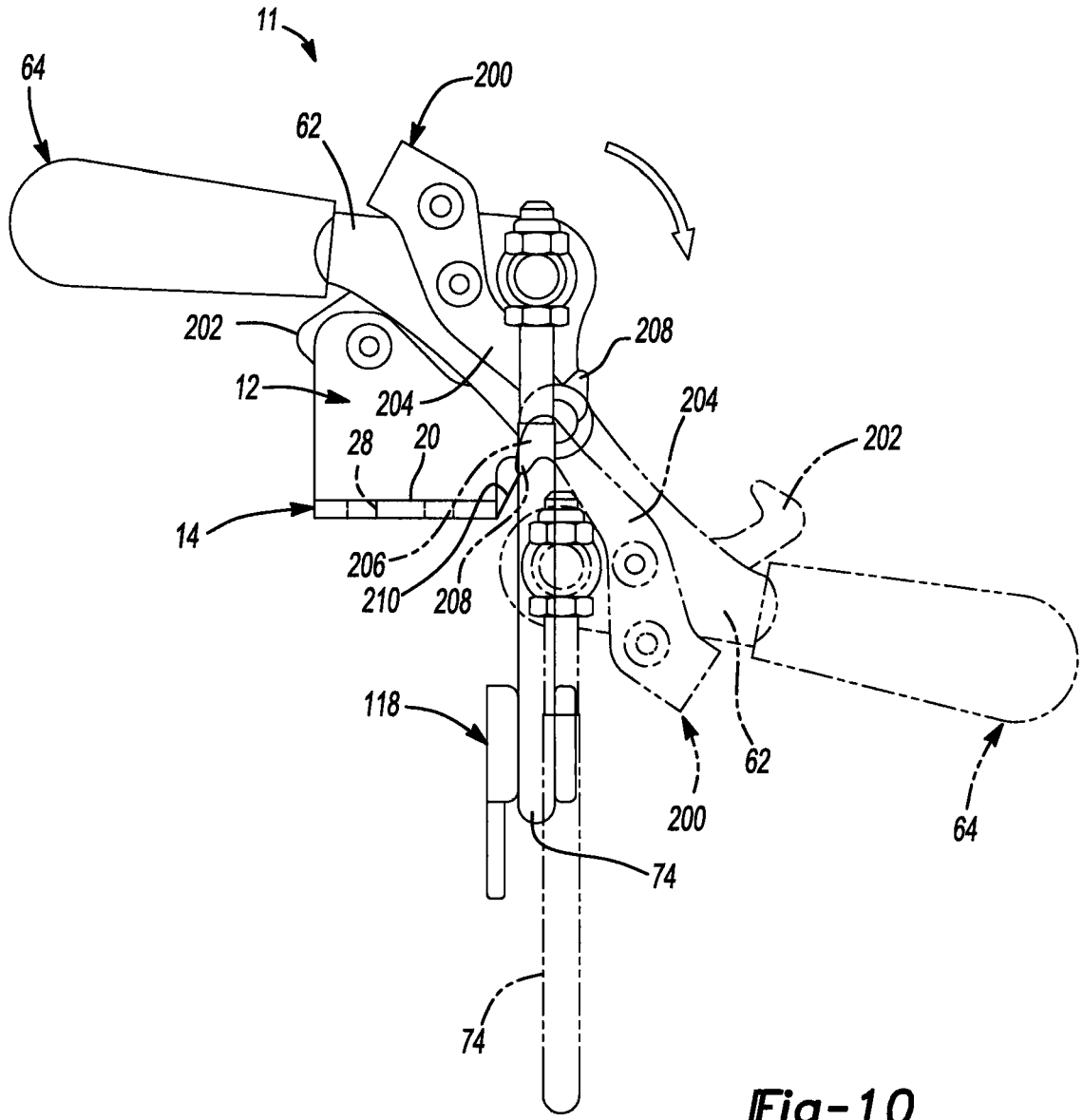
FIG. 10 is a side view of a holding clamp having a latch that locks the holding clamp in a disengaged position in accordance with a further example of the present teachings.

With reference to FIG. 10, a holding clamp 11 is shown with solid lines in an engaged position and shown in phantom lines in a disengaged position. The holding clamp 11 is similar to the holding clamp 10 but also includes a locking feature formed on a latch 200 that keeps the clamp in the disengaged or held open position while the operator removes and replaces the work pieces. The latch 200 includes a first leg 202 and a second leg 204. The first leg 202 engages the latch pin 50 in the same manner as shown in FIG. 1. When the first leg 202 is disengaged from the latch 50, the arm portion 64 may rotate away from the base to the disengaged position. In the disengaged position, a tip 208 formed near a first end 206 of the second leg 204 contacts a lip 210 on the first surface 20 of the base member 14 that prevents the arm portion 64 from moving to the engaged position. When the operator desires to move the arm portion 64 to the engaged position, the latch 200 is unlocked by forcing it in a direction generally away from the arm portion 64. When the latch 200 is forced away from the arm portion 64, the tip 208 rotates away from the lip of the base member 14 and toward the arm portion 64 allowing the arm portion 64 to travel to the engaged position.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A clamp for clamping a work piece to a fixture, comprising:

a base for mounting to the fixture;

a handle having an arm portion with a top surface and a bottom surface, the bottom surface nearer than the top surface to the base in a clamped position, the handle having a pivotal connection to the base;

a holding member for clamping the work piece to the fixture, the holding member pivotally connected to the handle; and a latch pivotally connected to the handle having a first end portion positioned below the bottom surface of the arm portion and a second user manipulation end portion positioned above the top surface of the arm portion, the first end portion is engaged with the base for locking the holding member and becomes disengaged from the base by a user directly contacting the second user manipulation end portion above the top surface of the arm portion and moving the second user manipulation end portion in a direction generally away from the top surface of the arm portion of the handle.

2. The clamp of claim 1 wherein the second user manipulation end portion of the latch moves away from the arm portion of the handle in a first rotational direction and the first end portion forms a hook that is positioned opposite the first rotational direction.

3. The clamp of claim 2 wherein the hook engages the base via a latch pin for locking the holding member in a holding position.

4. The clamp of claim 3 wherein the first end portion of the latch moves in the first rotational direction to disengage the hook from the latch pin.

5. The clamp of claim 4 wherein the handle is operable to rotate when the hook is disengaged from the latch pin.

6. The clamp of claim 5 wherein the holding member is released from the holding position when the handle is rotated in a direction generally toward the holding member.

7. The clamp of claim 1 wherein said latch includes a hook that engages the base for locking the holding member in a held open position.

8. The clamp of claim 1 further comprising a spring, the spring is pivotally connected to the latch and the handle.

9. The clamp of claim 8 wherein the spring urges the second user manipulation end portion of the latch toward the arm portion of the handle in a second rotational direction that is opposite a first rotational direction.

10. The clamp of claim 9 wherein the spring urges the first end portion of the latch in the second rotational direction, a hook of the first end portion automatically engaging with a latch pin when the handle moves the holding member into the holding position.

11. A clamp for clamping a work piece to a fixture, comprising:

a base for mounting to the fixture;

a handle having an arm portion with a top surface and a bottom surface, the bottom surface nearer than the top surface to the base in a clamped position and a first and second body portion, the handle having a pivotal connection to the base;

a holding member pin pivotally connected to the handle; a holding member having a first leg and a second leg that are connected to the holding member pin, the holding member having a holding position for clamping the work piece to the fixture and a releasing position for unclamping the work piece from the fixture, the holding member pivotally connected to the holding member pin;

a latch pivotally connected to the handle, the latch having a first leg and a second leg spaced and distinct from the first leg, both the first and second legs extending away from a middle portion in a same direction, the middle portion positioned above the top surface of the arm portion, the first leg having a first end portion that engages the base below the bottom surface of the arm portion when the holding member is in the holding position; and a pin pivotally connected to the latch and the handle, the pin defining an axis of rotation wherein the first end portion of the latch becomes disengaged from the base by rotating the middle portion of the latch about the axis of rotation in a direction generally away from the top surface of the arm portion of the handle.

12. The clamp of claim 11 further comprising a latch pin that is pivotally connected to the base, wherein the first end portion of the latch forms a hook that engages the latch pin when the holding member is in the holding position.

13. The clamp of claim 11 further comprising a spring that urges the middle portion of the latch about the axis of rotation in a direction generally toward the arm portion of the handle to engage the first end portion of the latch with the base when the holding member is in the holding position.

14. The clamp of claim 13 wherein the spring is disposed between the first and second body portions of the handle.

15. The clamp of claim 13 wherein the spring includes a first and a second arm, the first arm is in contact with the holding member pin.

16. The clamp of claim 15 further comprising a second pin pivotally connected to the latch wherein the second arm of the spring is in contact with the second pin.

17. The clamp of claim 11 wherein the holding member includes a middle portion that connects the first and second legs.

18. The clamp of claim 17 wherein the holding member middle portion is in contact with the work piece when the holding member is in the holding position.

19. The clamp of claim 11 wherein the holding member pin includes a first end that defines a first aperture and a second end that defines a second aperture, each of the first and second apertures formed perpendicular through the holding member pin.

20. The clamp of claim 19 wherein the first and second apertures each receive one of the first and second legs of the holding member.

* * * * *

UNITED STATES PATENT AND TRADEMARK OFFICE

CERTIFICATE OF CORRECTION

PATENT NO. : 8,561,973 B2
APPLICATION NO. : 12/356222
DATED : October 22, 2013
INVENTOR(S) : David Martin It is certified that error appears in the above-identified patent and that said Letters Patent is hereby corrected as shown below:

In the Specifications

Column 6
Line 10 "lip" should be --lip 210--

Signed and Sealed this
Fourth Day of March, 2014

Michelle K. Lee

Michelle K. Lee
*Deputy Director of the United States Patent and Trademark Office*